United States Patent [19]

Kaswan

[11] 4,027,679

[45] June 7, 1977

[54] TOBACCO PRODUCT

[76] Inventor: Joseph Kaswan, 3092 14th St., Astoria, N.Y. 11102

[22] Filed: Aug. 3, 1976

[21] Appl. No.: 711,218

Related U.S. Application Data

[63] Continuation-in-part of Ser. No. 534,478, Dec. 19, 1974, abandoned.

[52] U.S. Cl. ..... 131/9

[51] Int. Cl.[2] ..... A24D 1/00

[58] Field of Search ..... 131/8 R, 9, 10 A, 10 R

[56] References Cited

UNITED STATES PATENTS

| | | | |
|---|---|---|---|
| 3,065,755 | 11/1962 | Boyd et al. | 131/9 |
| 3,258,015 | 6/1966 | Ellis et al. | 131/7 X |
| 3,349,776 | 10/1967 | Bell et al. | 131/8 R |
| 3,356,094 | 12/1967 | Ellis et al. | 131/8 R |
| 3,674,036 | 7/1972 | Vega | 131/8 R X |
| 3,756,249 | 9/1973 | Selke et al. | 131/8 R X |
| 3,773,053 | 11/1973 | Stephens, Jr. | 131/9 |
| 3,774,622 | 11/1973 | Steigerwald | 131/8 R X |
| 3,863,644 | 2/1975 | Hunt | 131/9 |
| 3,905,377 | 9/1975 | Yatrides | 131/9 |

*Primary Examiner*—Robert W. Michell
*Assistant Examiner*—V. Millin

[57] ABSTRACT

This invention provides a smoke vector for a cigarette, and the like, for modifying or altering the mainstream smoke at or near the combustion zone or burning zone. The smoke vector comprises a thin walled elongated, impervious tube-like member or vector which is hollow and empty. The vector extends longitudinally through the cigarette and terminates with an impervious mouth end. During an indrawn breath by the smoker, the products of the combustion of tobacco in systemic heat is below the formation temperatures of temperature dependant hazardous chemicals.

5 Claims, 3 Drawing Figures

TOBACCO PRODUCT

This is continuation-in-part of application Ser. No. 534,478 filed on Dec. 19, 1974, now abandoned.

BACKGROUND

This invention relates to a smoke vector for modifying the smoke of tobacco products. In its more specific aspect, this invention relates to a smoke vector which mechanically and chemically modifies and alters the smoke drawn in by the smoker of a cigarette or the like.

U.S. Pat. No. 3,258,015, dated June, 1966, to Ellis et al. describes a smoking device which operates to release a nicotine flavored vapor from a nicotine-releasing material produced by the smoldering of tobacco when the smoker draws through a tube. It should be noted that Ellis et al. specifies that none of the products of combustion are drawn in by the smoker. Notwithstanding the benefits to the smoker who uses such a device, the annual increase in the use of cigarettes whose products of combustion are drawn in by smokers demonstrates a need to protect this latter group of smokers from the hazardous products of combustion produced by the cigarettes they smoke.

While this invention is described hereinafter with particular reference to cigarettes, it should be understood that the invention is also applicable to cigars and cigarillos as well.

Smoking has become a widespread habit, but in recent years has come under severe criticism as being dangerous to the smoker's health. Tobacco smoke is an areosol comprising gas and semi-liquid particles measuring from about 0.1 to over 1 micron. The burning zone has a temperature range of from 875° C to 1050° C. Within this temperature range both oxidation by burning and thermal degradation due to absence of oxygen occur but in different zones. The high temperature zone is in the axial center and is the region of thermal degradation of tobacco — a reductive process.

Adacent to the burning zone upstream of the burn the products of combustion and degradation are pyrolized and distilled and the smoke constituents drawn up the cigarette are re-pyrolized and re-distilled as the burning zone moves rearward along the cigarette.

Thus, a number of reactions are occurring such as de-hydration, de-hydrogenization, de-amination, cracking and pyrosynthesis, and in general, at the center of the burn, thermal degradation.

As a result of thermal degradation and pyrosynthesis, the smoke inhaled or sucked in by the smoker during a puff, sometimes called mainstream smoke ", contains numerous chemicals such as paraffins, low molecular weight carboxyl compounds, amines, pyridine, terpenes, polyaromatic hydrocarbons, and nicotine as well as carbon monoxide and particulate matter. Some or many of these chemicals are harmful to the smoker's health.

In order to diminish this health hazard, cigarettes are commonly provided with a filter at the upper or mouth end. These filters, which are well known in the art, remove one or more of these constituents from the smoke by mechanical or physical means and/or by absorption, thereby decreasing the amount of harmful matter drawn in by the smoker. Notwithstanding the effectiveness of these filters, harmful constituents in the smoke stream are decreased at best and a substantial amount of these constituents are inhaled by the smoker. Cigarette filters are, therefore, supportive of efforts to diminish the hazard to health from smoking, but are not corrective. Corrective measures require the elimination of harmful chemicals, not their reduction. In order to eliminate these chemicals, it is necessary to understand the theory of combustion of cigarettes which gives rise to their formation. It therefore would be of value to explain this theory in order to comprehend the corrective objectives and mechanism of this invention.

It has been established that many harmful chemicals in cigarette smoke are formed in the high temperature, oxygen-deficient zone immediately downstream of the burn. This region is commonly known as the coal. The formation of many of these chemicals is temperature dependant in this oxygen-deficient zone, being the products of thermal degradation of tobacco.

Attempts to reduce the temperature of the coal using additives has met with little success. This is also true of attempts to change the combustion characteristics of cigarette tobacco.

A more complete understanding of the cigarette as a combustion system is required to pinpoint the cause and achieve a resolution to thermal degradation of tobacco.

There are two types of combustion systems. One system is a stationary-fuel, moving-combustion zone system such as exemplified by smoldering rope, explosive fuse cord, candles, etc. The other system is a stationary-combustion zone, moving-fuel type such as gas burners, welding torches and oil burners. The combustion characteristics of the burner system are not affected by the combustion system to which the burner belongs, (although the stationary combustion-zone, moving-fuel combustion system permits greater fuel velocities).

Cigarettes are of the stationary-fuel, moving-combustion zone type of system.

There is a burner system in which the configuration of the burner has an effect on the combustion characteristics. It is the circular solid (as differentiated from hollow) combustion system. Circular burners, as do all burners, release heat in all directions. The released heat from the perimeter of the circular solid burner moves outwardly to the surrounding air and inwardly toward the axial center of the fuel. Adjacent burning points on the perimeter mutually exclude heat transfer from each other since they are both burning at the same temperature.

Heat released inwardly is transferred by conduction to the center, which acts as a collection point for heat from all points on the burning perimeter. The center, being the point of convergence of heat, is raised to a temperature substantially higher than any point on the perimeter.

The center releases its heat wherever it can. Typical directions of heat release are upward, forming a preheating zone for fuel, and downward for cooling by air, and laterally in all directions. Heat moving downwardly moves out from the point of convergence, radially forming a curved conical ember. Heat moving out laterally, moves out radially toward the burning perimeter. Since the burn itself is a source of heat, the opposing movement of heat from the point of convergence and from the burning perimeter, reaches a point of equilibrium, which, in a round burner, is a circle of equilibrium concentric with the burning perimeter.

The distance of a point on the circle of equilibrium from a point on the burning perimeter and the point of convergence of heat is dependant upon the temperature of the point of convergence and that of a point on the burning perimeter. The greater the heat of the coal in relation to a point on the perimeter, the closer the circle of equilibrium will be to the perimeter; conversely, the lower the heat of the coal, the closer will be the position of the circle of equilibrium to the coal.

Heat from any point on the burning perimeter radiated outwardly is determined by the temperature in the zone toward which the heat is moving. Thus, adjacent points on the burning perimeter mutually exclude heat transfer from one another since they are both at the same temperature. Additionally, the higher the temperature of the circle of equilibrium or the closer the circle of equilibrium to the burning perimeter, the less heat will move inward from the burning perimeter and the more heat will move outward from it. The outward release of heat from the burning perimeter warms and rarifies approaching air, thereby depleting the oxygen supply available for combustion.

The proximity of the circle of equilibrium to the burning perimeter, then, is a determinant of the rate of combustion. The temperature of the coal, being a determinant of the circle of equilibrium, is a determinant of the rate of combustion, and a secondary determinant of the rarefaction of approaching air and its percentage supply of oxygen for burning.

In all of the above, cigarettes behave as typical circular solid (as opposed to hollow) combustion systems. While the cigarette tobacco smolders, side stream smoke shows heat being released to air; while below the burn, the glowing ember maintains a constant length as the burn moves backward along the fuel. The constant length of the glowing ember is an indication of the existence of equilibrium between heat produced and heat released during the smolder.

During smolder, both heat produced by burning and heat removed by ambient air at the face of the ember, proceed at atmospheric pressure in ambient air. The rate of heat removal from the coal determines the temperature of the coal and the proximity of the circle of equilibrium to the burning perimeter, and in turn the rarefaction of approaching air by the heat of the burn, and therefore the rate of burning. By itself, therefore, a cigarette smoldering arrives at a constant rate of burning, and this is in equilibrium with the rate of cooling.

The effect of smoldering upon the cigarette as a solid circular combustion system is different from what the effect would be on a hollow circular combustion system. The cigarette, when smoldering, behaves as a typical solid circular combustion system in that heat from the burning perimeter moves in to the center and converges there, with the result that the fuel (tobacco) is raised to an exponentially higher temperature than any segment of the circle. For purposes of convenient identification this heat at the point of convergence can be called systemic heat since it is due to the characteristics of the combustion system to which the cigarette belongs.

When a smoker takes a puff and draws in smoke, he sharply increases the velocity of air moving into the burning perimeter by suction. Rarefaction of approaching air is overcome and the rate of burning is greatly accelerated. The smoker's draw upsets the equilibrium maintained by the cigarette in smolder by altering the condition that produce it.

Since the rate of cooling proceeds at atmospheric pressure in ambient air, the accelerated burn rate produces more heat than can be released in the same atmospheric conditions as smolder in the same increment of time as the draw. Thus, the heat release mechanism is overwhelmed during the draw.

Since the atmosphere cannot absorb the heat as quickly as it is produced during a draw, there is a time delay for release of heat. During this time delay more heat is being added by the rest of the draw to the heat not yet released because of the time delay. This causes a rise in temperature above the already high temperature of systemic heat.

This additional heat rise is sufficient to cause the tobacco in the center holding the heat to decompose. The products of this decomposition are harmful to the smoker. For purposes of convenient identification, heat rise caused by delay in heat release during a draw can be called draw heat.

In order to prevent the thermal decomposition of tobacco into products harmful to the smoker it is necessary to prevent the tobacco from reaching the temperature of decomposition. This can only be accomplished by preventing the coupling of systemic heat with draw heat.

It is the object of this invention to redirect the draw heat more quickly to the atmosphere thus precluding a time delay for release, thereby preventing coupling draw heat with systemic heat.

The ambient air that surrounds a burning cigarette absorbs the heat. The air molecules absorb the heat at essentially a fixed rate: each molecule absorbs a fixed amount of heat. The increased molecular activity caused by the absorption of heat causes the air envelope to expand and move away from the source of heat, while cooler air moves in to replace the expanding air. In a continuing system, this becomes a preferential direction of flow.

In a circular system such as a cigarette, the movement of cool air into the combustion zone is radially inward. This radial movement has the effect of narrowing the space in which the hot expanding gas is moving away. The net effect is to force the expanding gases into a column, while at the same time increasing the axial outward flow velocity of the hot gases.

The higher the temperature of the source of heat relative to the surrounding air the greater the amount of molecules will be needed to remove the heat, and therefore the greater the volume of air to contain the greater amount of molecules. This is accomplished spontaneously in free air by increased velocity of convection currents to bring a greater amount of cool air across the face of the heat source.

It is advantageous, therefore, to make use of the added air flow of convection currents by increasing the temperature differential between the end of the cigarette and the atmosphere.

In cigarettes, as they are currently manufactured, systemic heat moves from the point of convergence radially outward in all directions by conduction. There are temperature gradients between the point of convergence and the greater outside face of the ember meeting the air. There is also a temperature drop from the coal to the outside face due to distribution of heat to a greater total area.

The resulting temperature drop and point by point distribution of heat on the outside face of the ember results in a lowered temperature differential between any one point and the atmosphere. This low differential is the determinant for convection current velocity. By reason of this invention the smoke vector provides the means to increase the temperature differential between the end of the cigarette and the atmosphere thus accelerating convection currents and drawing cool air to the end of the cigarette for accelerated heat removal.

Accelerating heat removal will have the effect of preventing coupling of draw heat to systemic heat thereby preventing the decomposition of tobacco in the coal into harmful chemicals.

THE INVENTION

The invention comprises a thin walled cylinder or smoke vector disposed in the longitudinal axis of the cigarette. The cylinder or vector is sealed at the mouth end and open at the front end, and it is substantially impervious relative to the draw strength of the smoker. The vector is made of an inert material and desirably may be segmented for removal of unneeded sections as the cigarette burns down. Further, the vector exhibits a relatively high specific heat so as to be essentially transparent to heat whereby there is established a preferentail direction of flow of heat from the burning tobacco through the wall of the vector to the air inside the tube.

In order to maintain the largest differential in heat between the air in the tube and the air outside the cigarette it is essential that heat transported through the wall of the vector be transferred directly to air and that there be no material between the interior wall of the vector and the air inside the vector which might absorb heat, since any absorption of heat would lower the differential between the high temperature inside the vector and the free air outside the cigarette. Thus, air inside the vector is in direct contact with all points of the interior wall of the vector with nothing else interposed.

With this construction, the preferential direction of flow is established as a venturi effect, accomplishing a temperature decrease in the coal.

During a draw, heat added to the point of convergence will first impinge the outer face of the vector and then pass readily by conduction to the inner face of the cylinder. The heated interior walls of the cylinder will be raised to a high temperature as the point of convergence of heat. With the increase of heat during the draw the air inside the cylinder will increase in temperature creating a larger differential with respect to the free air outside the open end of the vector. This increased differential will accelerate both the movement of heated air away from the open end, and the radial movement of cool air inward to replace the warmed air, thus maintaining atmospheric pressure. This continuous and accelerated flow will remove the heat added to the cigarette by the increased rate of burning during the draw and prevent the coal from reaching the temperature of thermal decomposition.

This invention together with other objects may be best understood by referring to the following detailed description, and the drawings in which.

Figure 1:
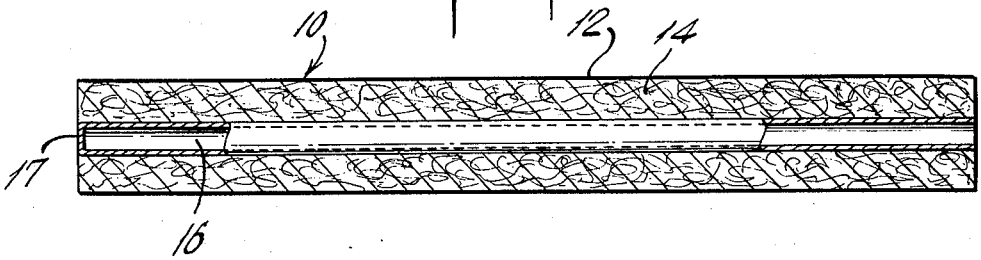
FIG. 1 is a cross-sectional view of a cigarette showing the smoke vector of this invention.
Figure 2:
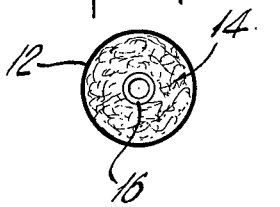
FIG. 2 is front end view of FIG. 1.

Broadly my invention for a smoke vector comprises a longitudinally disposed insert extending substantially the length of the cigarette. The smoke vector is concentrically arranged in the body of the cigarette so as to be surrounded by tobacco. It is essential that the vector be sealed at the mouth end and be open at the front end in order to establish the proper convection currents so that the coal will remain below its thermal decomposition temperature as explained above.

In order to describe the invention in greater detail, reference is now made to the drawings wherein like reference numerals designate similar parts throughout. The cigarette, shown generally by the numeral 10, is provided with a typical paper wrapper 12 as the outer shell to encase the tobacco 14. Smoke vector 16 extends longitudinally through the center of the cigarette so as to be concentrically arranged therewith. The vector extends from the front or burning end to the upper or mouth end of the cigarette so as to be substantially coterminous with the wrapped tobacco. The vector is sealed or capped with a substantially impervious cap member or seal 17 at the mouth end.

The vector 16 may be formed of a ceramic or metal structure, for example, and must be capable of withstanding the temperature of burning of a cigarette and may include, for example, fused quartz, or stainless steel. The vector can be of granular construction and be pressed or molded to shape, or may be held together with high temperature cement or the vector may be made of rigidized foam. The advantage of granular or rigidized foam construction is that as the cigarette burns down the used portion of the vector may be tapped off making the shortened remaining vector more efficient. The vector desirably may have dimensions of 2½ or 3 millimeters in diameter, and have a wall thickness that may vary from ⅓ millimeter to 1 millimeter. The empty center of the vector may be ½ millimeter to 1 and ⅓ millimeter. Variations in performance may be accomplished by varying the outside diameter and wall thickness of the vector.

Cigarette 10 may be provided with a conventional mouthpiece (not shown) formed of a substantially impervious material such as paper, to prevent the intake of air when the smoker drawn on the cigarette. The mouthpiece spreads and cools the indrawn smoke and may also include a filter for smoke.

Figure 3:
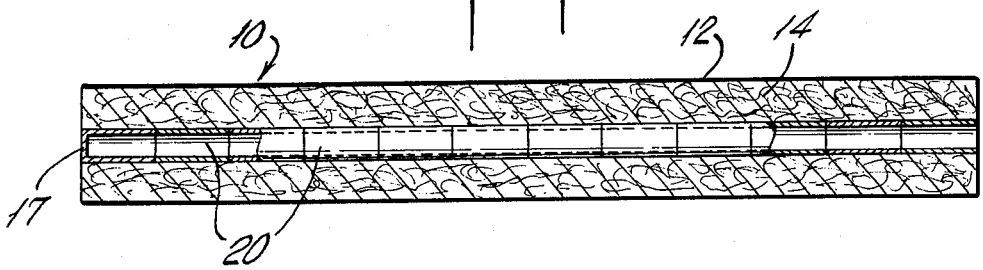
FIG. 3 is an alternative embodiment of the invention.

According to the embodiment shown in FIG. 3, the smoke vector 20 is a cylinder or tube comprising a plurality of segments extending beyond the tobacco that may be tapped off. In this manner, the unneeded portion of the smoke vector is continuously removed, and the remaining vector kept efficient.

Although the vector is preferentially of circular cross section, as is the preferential shape of cigarettes, the vector may be of any desired configuration such as elliptical.

It will be observed that the smoke vector has the distinct advantage of providing a technical and economic means for modifying or altering smoke so that it is less harmful to the smoker. The mainstream smoke is modified to less harmful chemicals during pyrolisis or distillation. Certain harmful chemicals may be prevented from forming, while others may be changed, if formed, during combustion.

It will be understood that the smoke vector described may be varied without departing from the invention.

It is claimed:

1. A cigarette which comprises a. a thin walled, hollow smoke vector, of ceramic or metal construction, extending longitudinally substantially the length of and disposed concentrically therewith so as to be surrounded by tobacco, b. said vector comprising a substantially impervious hollow and empty cylindrical member having a substantially impervious closed mouth end and an open front end, c. said vector establishing the heat removal sequence during a draw by collecting draw heat at the point of convergence inside the vector, creating the highest possible temperature differential between the open end of the vector and free air outside the vector, and removing heat by high velocity convection currents, d. whereby the smoker draws in, during a puff, smoke comprising the products of the combustion of tobacco in systemic heat, below the formation temperatures of temperature dependant hazardous chemicals.

2. A cigarette according to claim 1 wherein said vector is a refractory oxide.

3. A cigarette according to claim 1 wherein said vector is made of fused quartz.

4. A cigarette according to claim 1 wherein said vector is made of stainless steel.

5. A cigarette according to claim 1 wherein said vector comprises a plurality of segments which may be removed as smoking progresses.

* * * * *